US005791816A

United States Patent [19]

McCallion

[11] Patent Number: 5,791,816

[45] Date of Patent: Aug. 11, 1998

[54] CONCRETE JOINT RESTRAINT SYSTEM

[76] Inventor: James McCallion, 23352 Saint Elena, Mission Viejo, Calif. 92691

[21] Appl. No.: 742,251

[22] Filed: Oct. 31, 1996

[51] Int. Cl.[6] ..... E04C 5/20; E01C 11/18

[52] U.S. Cl. ..... 404/136; 52/677; 52/687

[58] Field of Search ..... 404/134, 135, 404/136, 70; 52/684, 687, 689, 677; 248/313, 316.2

[56] References Cited

U.S. PATENT DOCUMENTS

| | | | |
|---|---|---|---|
| 1,306,984 | 6/1919 | White | 52/689 |
| 2,375,361 | 5/1945 | Hillberg | 404/136 X |
| 2,439,428 | 4/1948 | Hillberg | 404/136 X |
| 3,471,987 | 10/1969 | Yelsma | 52/684 |
| 3,694,989 | 10/1972 | Oliver et al. | 52/687 X |

OTHER PUBLICATIONS

Dayton Superior Catalog I–90E, Jan. 1, 1990.

USPTO Disclosure Document #376987, recieved in the U.S. Patent Office on May 30, 1996.

*Primary Examiner*—Tamara L. Graysay
*Assistant Examiner*—Sunil Singh
*Attorney, Agent, or Firm*—Price, Gess & Ubell

[57] ABSTRACT

A dowel support for use in concrete joint restraint system as is typically used for slabs in highway construction is provided, as is a concrete reinforcing system employing the dowel supports. The dowel support is used to support dowels of different diameters and, in a preferred embodiment, is made of a noncorrosive material to reduce corrosion at the dowel-support interface. The support of the present invention is especially suited for fiberglass reinforced plastic (FRP) dowels which are resistant to corrosion, and the combination of the fiberglass dowel with the support of the present invention provides an improved alternative to the steel basket supports presently in use. The supports use a wedge-shaped vertical mouth to receive the dowels, which are supported between the sides of the mouth at the width corresponding to the diameter of the dowel. An arched gate encloses the dowel in the mouth and secures the dowel in position prior to the introduction of the concrete, and each support can be aligned in a spaced apart position. The gate has wedges at lower ends which mate with the stand to lock the gate onto the dowel and prevent the dowel from being dislodged during the placing of the concrete. In an alternate embodiment, the gate may be replaced with a strap or other flexible retention mechanism which can secure the dowel quickly and rigidly in the stand. End caps are provided at one end of the concrete reinforcing system to allow for thermal expansion of the dowels, and a pane of typically fibrous material serves as a joint expansion for adjacent concrete blocks.

27 Claims, 5 Drawing Sheets

CONCRETE JOINT RESTRAINT SYSTEM

BACKGROUND OF THE INVENTION

1. Field of the Invention

The invention relates generally to pavement/slab construction and, specifically, to a system for supporting variable diameter concrete joint restraint devices, commonly termed dowels, and supports designed to provide corrosion resistant concrete joint restraint for use in pavement construction as well as various concrete applications.

2. Description of Related Art

The present invention pertains to improvements in the field of pavement construction such as those designed for highway transportation. It is well known that concrete has a comparatively high compressive strength, a comparatively low tensile and shear strength, and that concrete expands and contracts due to changes in temperature. Because highways can experience large temperature changes over the course of a calendar year, accommodations must be made for the resulting changes in the concrete. For example, winter temperatures may cause the concrete to experience subzero temperatures, while the same concrete may be exposed to temperatures of over 100° F. in the summer. The thermal expansion and contraction of the concrete under these conditions can prove destructive, leading to cracking and surface discontinuities if the proper precautions and measures are not taken. In addition concrete will crack naturally, as a result of the curing process, which takes place from the time of placement of the fluid concrete material, until full design strength is achieved. This occurs usually within one month after initial placement of the concrete. Engineers have found that a series of concrete blocks or slabs positioned with a gap to relieve the stresses in the blocks at the maximum expansion anticipated provides the best solution to these problems. Joints or spacing in between the blocks are necessary to accommodate thermal expansion and contraction of the concrete due to changes in the environmental temperatures, and strategic placement of the joints assist engineers in controlling the direction of the expansion and predicting the location where the concrete will crack as a result of the curing process.

The use of discrete blocks, however, is not without it own problems. Uneven expansion or contraction of the individual blocks can result in discontinuities in the highway which, in turn, can lead to unsatisfactory road conditions as well as stress and fatigue in the individual blocks. Blocks can shift up to create unsafe road conditions and reduce the life of the road. To solve this problem, the construction of concrete pavements have for a long time used dowel bar inserts as load transfer mechanisms. As early as 1917, dowel bars have been used to transfer shear loads at joints in the concrete blocks which make up the pavement. Dowels placed longitudinally in the blocks allow the concrete blocks, or slabs, to expand in the longitudinal direction but resist expansion in the traverse direction of the dowels. By controlling the direction of the expansion of the slabs, engineers can prevent the driving surface of the pavement from becoming discontinuous and uneven.

Previously, steel dowels were the exclusive material used for the joint restraint of the concrete. Steel dowels are relatively cost effective and provide the necessary strength required by this application. However, steel dowels have a corrosive tendency when exposed to the harsh environments of the highway, such as salt, oil, dirt, and moisture which seeps between the joints and attacks the dowels. Corrosion results in the dowel binding because the concrete can no longer expand along the dowels, which severely reduces the load transfer efficiency and can also result in the failure of the dowel if the stresses become large enough.

Various dowel protective coatings have been used to prevent corrosion at the dowel/concrete interface. In addition to preventing corrosion, coatings promote movement in the longitudinal direction which increases the load transfer efficiency. The ideal coating would have a low coefficient of friction with the concrete and a high resistance to corrosion, be safe to work with, and be economical. Both powders and epoxy resins have been used with some success in the art, but no ideal coating has been found to date. The biggest problem is that the most effective coatings are often times harmful to the environment or fail to meet strict code requirements.

Fiberglass dowel bars and Fiber Composite (FC) dowels have been recently tested in laboratories to replace the steel dowel bars. Fiberglass dowels are much less susceptible to corrosion than the steel counterparts and, thus, they do not require coatings which can be harmful to the environment. The current cost of fiberglass dowel bars can exceed the cost of steel dowels. Aside from the cost considerations, Fiberglass Reinforced Plastic (FRP) dowels have been shown to compare favorably with steel bars in terms of performance.

The prior art used steel wire baskets to position the dowel bars in the concrete, for either a slab/pavement expansion or contraction situation, as determined by design. For pavement construction, slab/pavement subgrade is accurately graded and a basket or cage would be placed on the subgrade. The dowel bars would then be positioned in the basket in a parallel alignment and the concrete would be placed in position. The dowels are preferably positioned so that the midpoint of the dowel lies at the joint or juncture of two adjacent slabs of concrete at the midpoint of the slab vertical dimension. In this manner the slabs are permitted to move horizontally in the longitudinal direction of the dowel into the gap provided for at the joint, but vertical or lateral movement of the slabs is restrained.

The biggest concern with this method is that the prior art baskets are steel and as such suffer from the same shortcomings as the steel dowels. That is, the steel baskets corrode or degrade causing the dowels and concrete to lock up. At times, corrosion protection is afforded by coating as hereinbefore described for dowels, with the same inherent problems. The art lacks a noncorrosive support system which is designed for fiberglass dowels and is likewise resistant to corrosion. Furthermore, the support system of the prior art is specific to a specific size dowel and cannot accommodate dowels of variable-sized diameters. A versatile support system is preferable because fewer supports are needed for inventory and because the supports for different-sized dowels become interchangeable. Additionally, the wire basket systems of the prior art were bulky and took up significant space, and were not easily assembled or disassembled, and two specific types of basket are required for either expansion or contraction, added to the specific types of steel baskets required for dowel size, height, and corrosion protection.

OBJECTS AND SUMMARY OF THE INVENTION

It is a first object of the present invention to provide a support which can be used with a fiber composite (FRP) concrete dowel;

It is another object of the present invention to provide a support which is more versatile and more easily transported than the baskets of the prior art;

It is yet another object of the present invention to provide a support which can be used with a variety of different-sized diameter concrete dowels;

It is still another object of the present invention to provide a system of concrete reinforcing dowel support which does not corrode; and It is still another object of the present invention to provide a concrete dowel system adapted specifically for use with fiber composite dowels (FRP).

The present invention seeks to solve the shortcomings of the prior art and teach a dowel support assembly which can support variable-sized diameter dowels for concrete joint restraint and which resists corrosion. The support assembly provides for alignment of the dowel supports and maintains the dowels rigidly once placed in the support assembly. The assembly is preferably made of plastic or other suitable corrosion resistant material and is sturdy enough to maintain the dowels in the proper alignment. As with all such support systems of the art, the support assembly permits movement of the dowels in the longitudinal direction while fixing the dowel in the radial direction. Many existing basket assemblies require that the dowels be preloaded into and securely attached to the basket at a manufacturing facility, but the present invention allows the support assembly to be constructed immediately prior to placing the concrete on the subgrade. The system includes end caps which allow the dowels to expand once the concrete has cured, and spacers which set the distance between both adjacent stands and cooperating stands.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically for concrete joint restraint assemblies.

Figure 1:
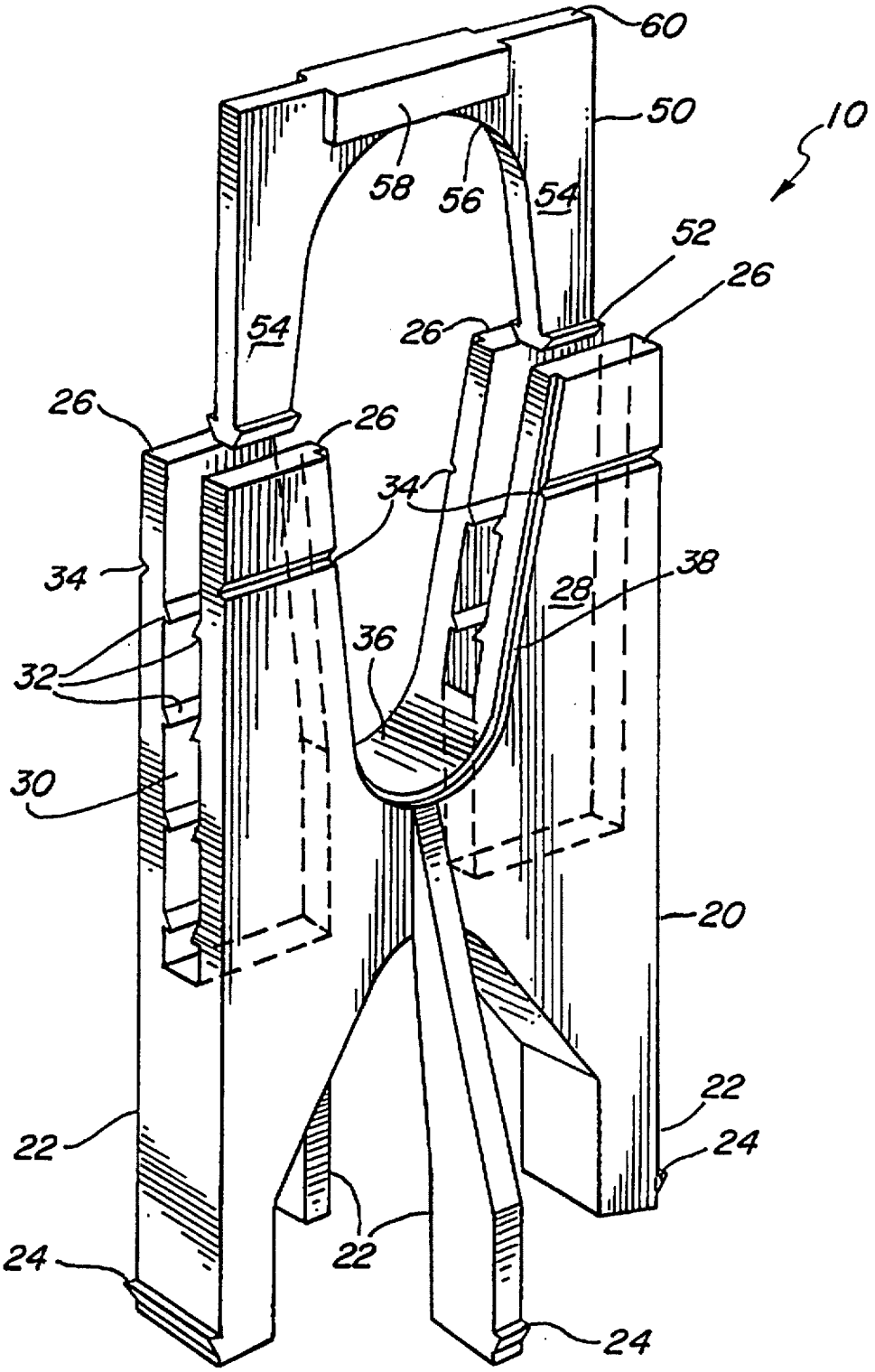
FIG. 1 is a perspective view of a preferred embodiment of a dowel support stand.
Figure 4:
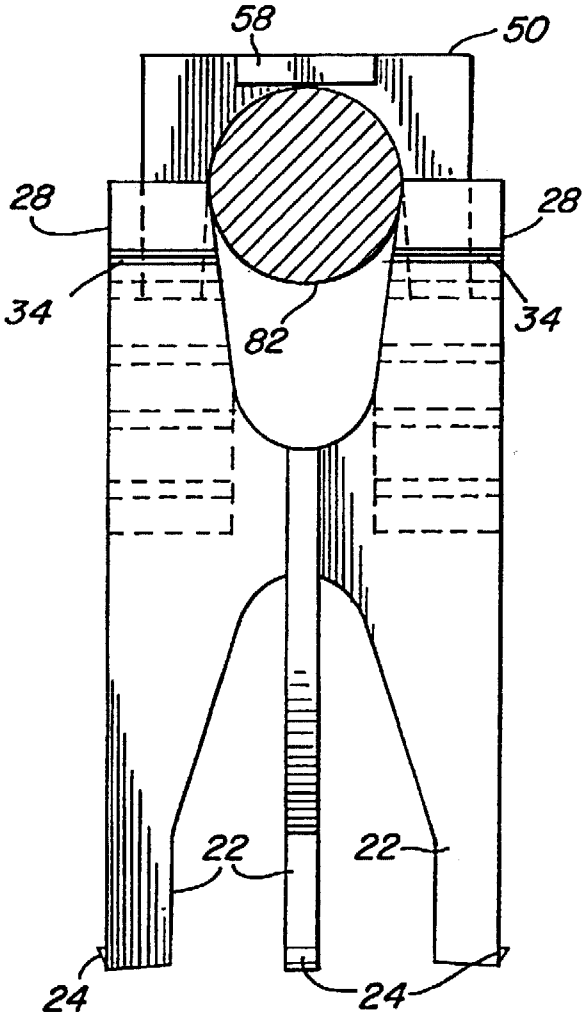
FIG. 4 is a front view of a preferred embodiment of a dowel stand with a maximum diameter dowel supported.
Figure 3:
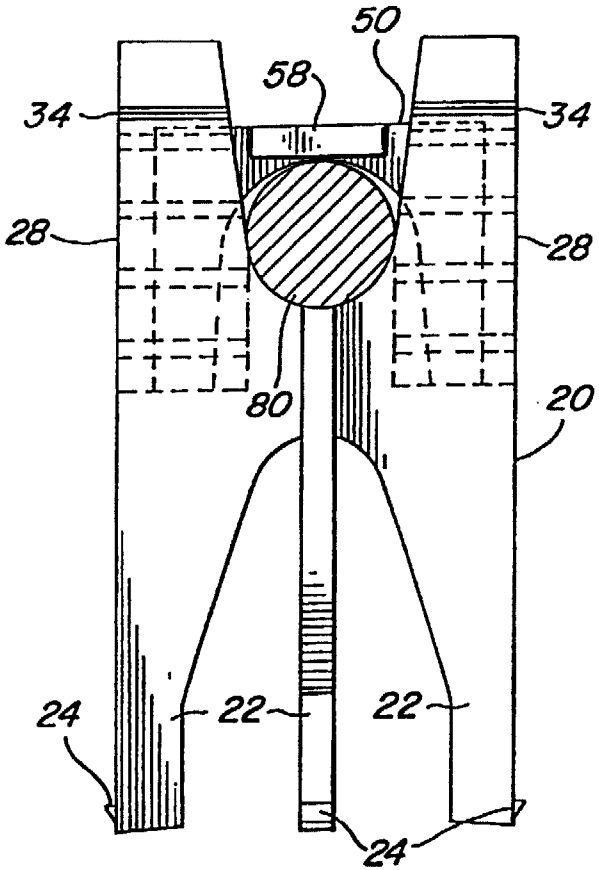
FIG. 3 is a front view of a preferred embodiment of a dowel stand with a minimum diameter dowel supported.

A dowel support stand of a preferred embodiment is shown generally in FIGS. 1–4. The stand 10 is comprised of a base 20 and a gate 50 which cooperate to secure a dowel 80 in the stand. As shown in FIGS. 3 and 4, the stand 10 can be used with different-sized diameter dowels 80, 82 without modification. The stand 10 is preferably made of a noncorrosive plastic or fiberglass (FRP) material to avoid the problems of corrosion. The base 20 includes a plurality of legs 22 which are used to balance the base 20, and each leg 20 includes retaining tabs 24 at the bottom which are used to secure the stand to a mounting plate. The base 20 is generally planar and comprises a vertical mouth 36 into which the dowel is seated. The vertical mouth 36 is wedge-shaped with the widest section at the top of the base and the narrowest section at the bottom of the mouth 36. The width of the mouth 36 is calculated to accommodate the entire range of diameter dowels for the particular stand 10, where more than one stand of the current art may be necessary to accommodate a range(s) of dowels. For example, the largest diameter dowel 82 corresponds the width at the top of the mouth and the smallest diameter dowel 80 will rest in the bottom of the mouth, and any intermediate-sized dowel will become wedged or trapped between the top and bottom of the mouth corresponding to the width of the width at that point. In this manner, two stands positioned at opposite ends of a dowel will support the dowel at the same distance above the ground, thereby ensuring that the dowels are parallel to each other and aligned properly (see FIG. 5).

Figure 2:
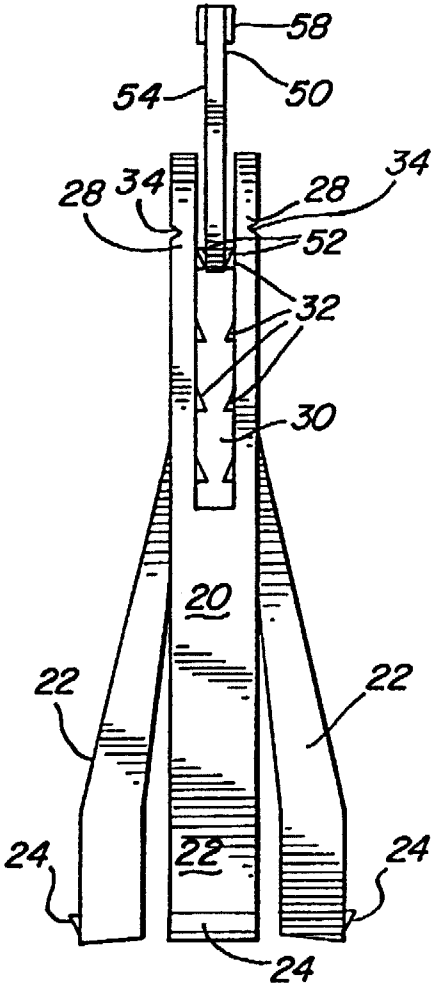
FIG. 2 is a side view of a preferred embodiment of a dowel support stand.

The wedge-shaped mouth 36 is formed by two vertical extensions 28. Each vertical extension 28 comprises two sheet members 26 parallel to each other and spaced apart to provide a gap or channel 30 therebetween. The channel 30 extends from the top of the stand to below the bottom of the vertical mouth 36 as shown to provide a passage for a retaining member. In a first preferred embodiment, the retaining member comprises a gate 50 which slides between the sheet members 26 to trap the dowel 80, 82 into the base 20 at the vertical mouth 36. The gate in one preferred embodiment includes pronged tips 52 on each of two arm members 54 which engage notches 32 in the sheet members 26 to "lock" the gate 50 into the base 20. The gate 50 has an arched lower edge 56 which bears against the upper surface of a dowel to prevent the dowel 80, 82 from dislodging from the stand 10, and a reinforcing block 58 at the upper edge 60 which provides a gripping surface as well as makes the gate 50 sturdier. The notches 32 are spaced vertically to allow the gate 50 to accommodate different-sized dowels and still lock tight onto the dowel. The notches 32 and the pronged tips 52 of the gate are orientated as shown in FIG. 2 such that the gate 50 will enter the channel 30 but will not dislodge from the channel once the pronged tips 52 have passed the first set of notches 32. In a preferred embodiment, the base 20 includes a horizontal recess 34 on each set of sheet members 26 which allows the uppermost portion of the base to be optionally broken away. As shown in FIG. 3, when the smallest diameter dowel 80 is used, the base 20 extends above the gate 50, unnecessarily increasing the height of the stand. The recesses 34 allow the stand to be shortened in this case by breaking away the uppermost portion of the base at the recess and discarding the unused pieces. The base 20 also includes in a preferred embodiment a recess 38 along the contour of the vertical mouth 36 which is used to seat an end cap 94 at its open end 96.

Figure 6:
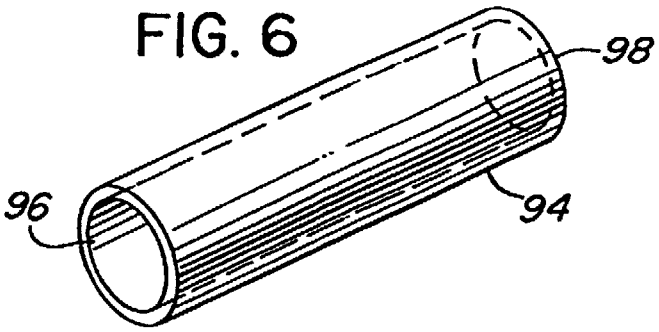
FIG. 6 is a perspective view of an end cap.
Figure 5:
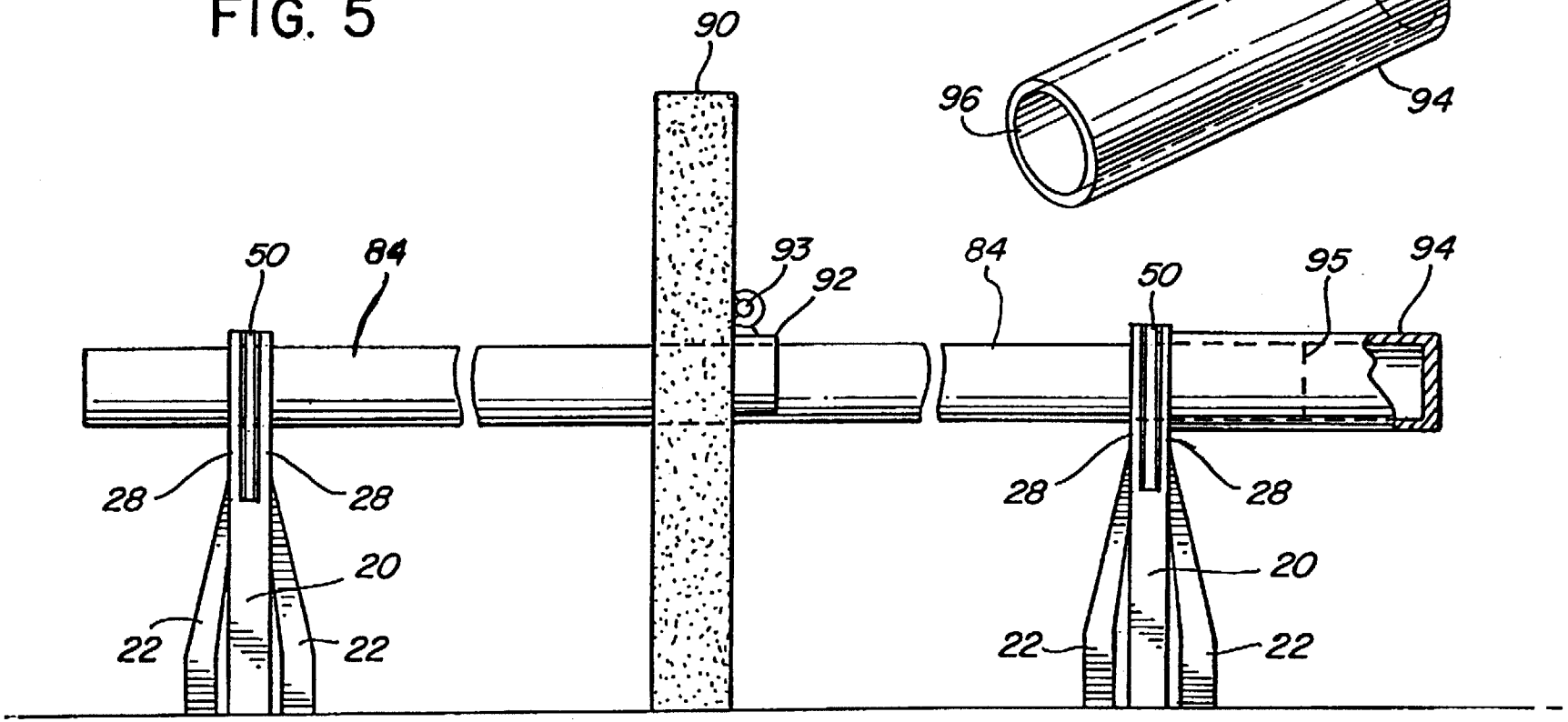
FIG. 5 is a side view of two stands of a preferred embodiment supporting a dowel, and further illustrating the expansion joint and the end cap.

The support assembly is shown in FIG. 5, where a dowel 84 is supported by two stands 20. An expansion joint 90 is positioned between the two stands 20 and is used to separate concrete blocks and to provide relief to stresses incumbent as the concrete expands due to thermal expansion. The expansion joint 90 includes a hole to accommodate the dowel and is typically made of a fibrous material which compresses as the adjacent concrete blocks expand to relieve the stresses. A joint indexer 92 is placed on the dowel at the expansion joint 90 and a rod 93 is inserted into the joint indexer 92 which bears against the expansion joint 90. It should be noted that the expansion joint 90, joint indexer 92, and rod 93 are not required in a contraction joint configuration. To further relieve the stresses as the dowel 84 expands, an end cap 94 is placed over one end 95 of the dowel 84. The end cap 94 fits into the recess 38 of the stand and extends beyond the end 95 of the dowel 84. The end cap 94 allows the dowel to expand freely therein so that the dowel does not buckle, as would be the case if the dowel was not allowed to expand. The end cap 94 as shown in FIG. 6 comprises an open end 96 and a closed end 98 to provide a closed space for the dowel to expand.

Figure 7:
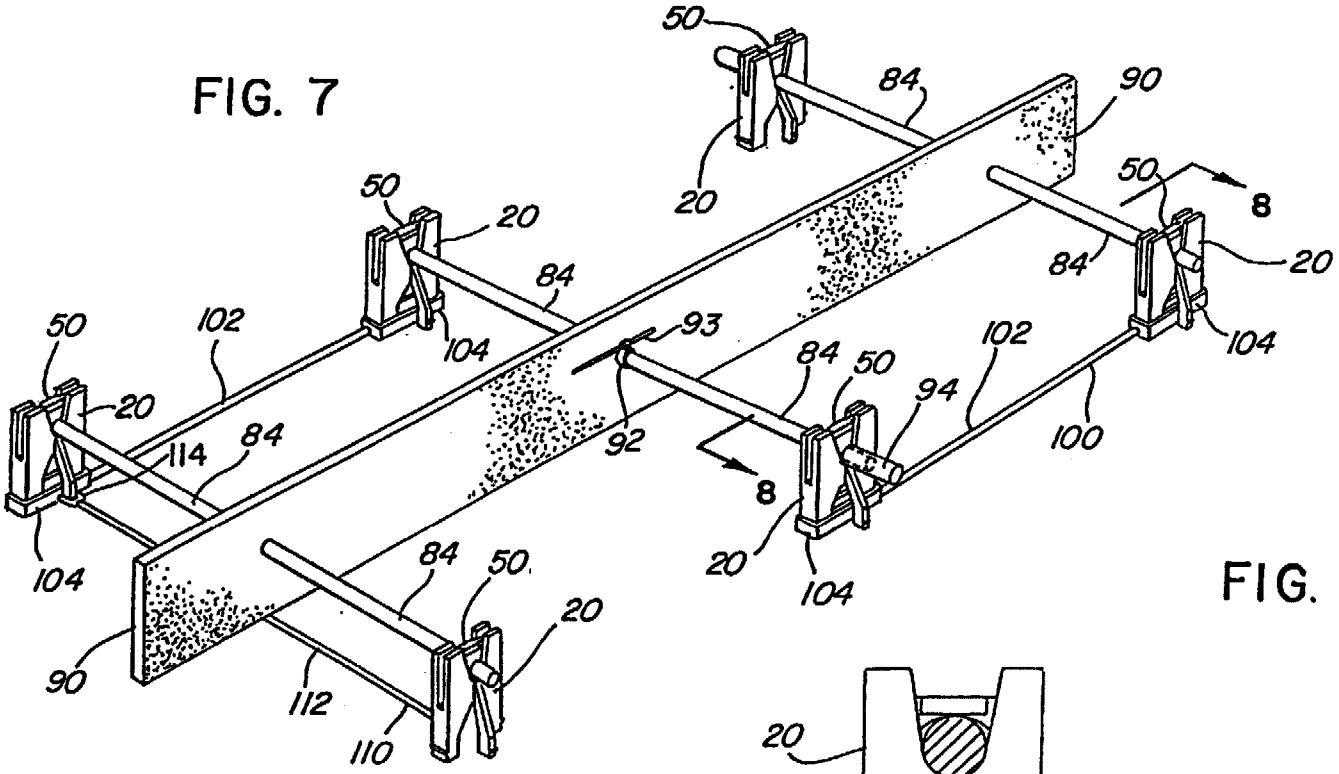
FIG. 7 is a perspective view of a concrete joint restraint system of the present invention illustrating multiple dowels and supports, and illustrating runners to space the dowel support stands.
Figure 8:
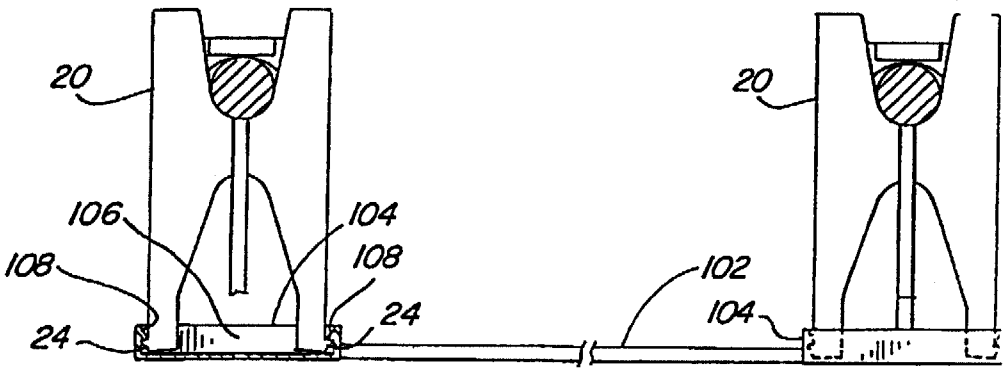
FIG. 8 is a side view of the retaining members on the dowel support stand cooperating with the retention plates.

Turning now to FIGS. 7 and 8, the basket assembly of the prior art is shown to be replaced with a series of stands supporting a plurality of dowels. The expansion joint 90 traverses the assembly and includes regularly spaced holes through which the dowels 84 pass. Each dowel 84 is supported by two stands which secure the dowel in place, and alternating adjacent stands are connected to runners 100 which are used to maintain the proper spacing between the dowels 84. The runners are comprised of a spacing rod 102 of plastic or other noncorrosive material which separates two mounting plates 104 which are designed to secure a stand in the recessed area 106. The mounting plates 104 have an inward directed lip 108 at the top edge which cooperates with the retaining tabs 24 on the legs of the stand to lock the stand on the mounting plate 104 as shown in FIG. 8. Similarly, each pair of stands may have a spacer 110 which is used to maintain the proper spacing of the stands supporting a common dowel. The spacer 10 is a rod 112 in which each end engages the nearest leg of the connecting stands, such as the U-shaped ends 114 shown in FIG. 7. Other configurations which engage the stand can be devised and the invention is not to be limited to the specific embodiment shown.

Figure 9:
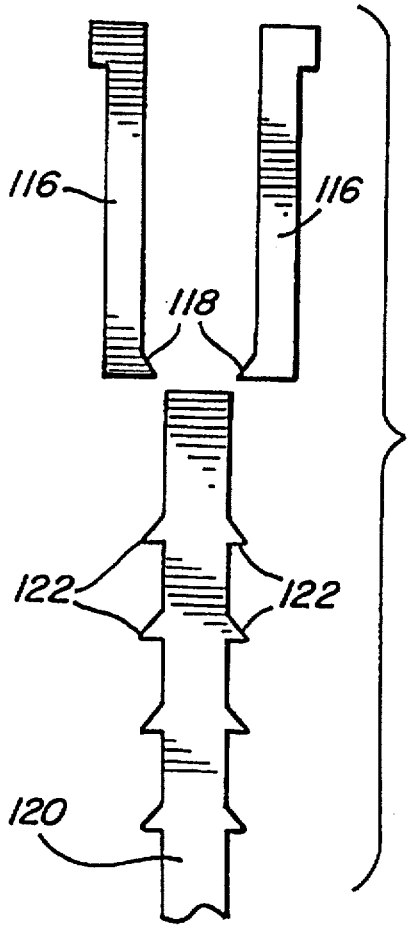
FIG. 9 is side view of an alternate embodiment of the gate and stand assembly.
Figure 10:
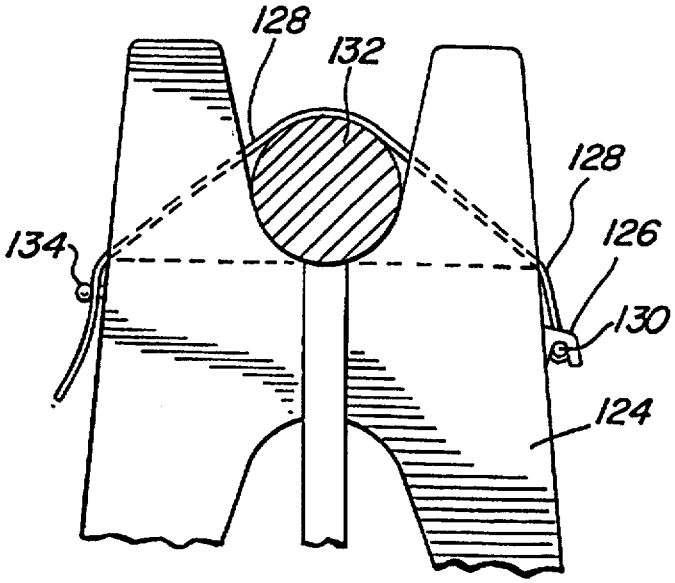
FIG. 10 is a front view of an alternate embodiment of the stand with a strap in place of a gate.
Figure 11:
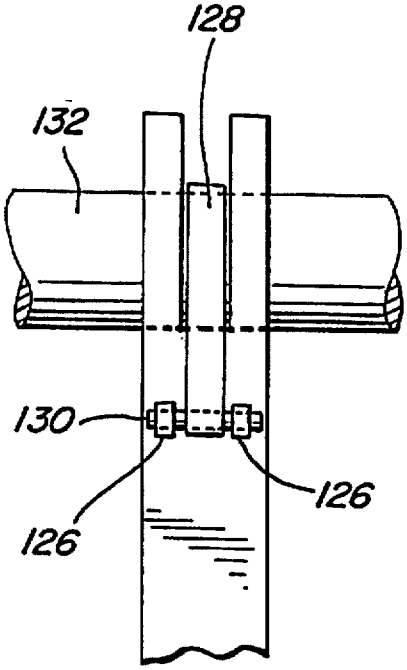
FIG. 11 is a side view of the embodiment of FIG. 10.

The invention as described can be stored easily and is readily constructed on site to facilitate the joint restraint device. Since single stands can support more than one-sized dowel, fewer replacement inventory is necessary. It should be noted that the relationship between the gate and the base can be altered. For example, in FIG. 9 an alternate embodiment is shown wherein the gate is comprised of two panels 116 with notches 118 at the bottom, and the stand 120 is a single sheet with vertically spaced tabs 122 such that the gate fits over the stand rather than inside the stand of the first embodiment. Also, other modes of securing the dowel into the stand can be envisioned such as a strap which is secured at a first end of the stand, and which passes over a dowel seated in the stand and which may be fastened at the other end to provide an adjustable securing method. As shown in FIGS. 10 and 11, the strap 128 is secured at a first end by a bar 130 at the end, which is held in place by hook like members 126 on the stand 124. The strap 128 passes over the dowel 132 as shown and is fastened at the other end by means of a peg 134 which is inserted into one of a plurality of holes (not shown) in the strap 128. It is to be understood that the securing of the strap onto the stand can be achieved in numerous ways, such as a clasp and catch, or a buckle. In all of the embodiments described, the dowel is fixed in the radial direction.

It will be understood that the embodiment described herein are merely exemplary and that a person skilled in the art may make many variations and modifications without departing from the spirit and scope of the invention. All such variations and modifications are intended to be included within the scope of the invention as defined in the appended claims.

What is claimed is:

1. A mounting apparatus for supporting one end of an elongate concrete dowel, wherein said elongate concrete dowel is one of a plurality of dowels having various size diameters, said mounting apparatus comprising:

a stand comprising a first and second spaced apart vertical extensions defining a wedge-shaped vertical mouth adapted to receive said dowel therebetween, said vertical mouth having a width at an upper end greater than a diameter of a largest diameter dowel among said plurality of dowels, and said vertical mouth gradually reducing in width at a lower end adapted to receive a smallest diameter dowel among said plurality of dowels thereon such that a dowel having a diameter between said largest diameter dowel and said smallest diameter dowel will rest in said vertical mouth at an intermediate height between said upper end and said lower end; and means for securing said dowel within said vertical mouth in the radial direction while permitting said dowel to slide axially in said stand.

2. The mounting apparatus as recited in claim 1 wherein said mounting apparatus is comprised of a corrosion resistant plastic material.

3. The mounting apparatus as recited in claim 2 wherein each said vertical extensions comprise first and second spaced apart sheets defining a channel therebetween, and wherein said means for securing said dowel comprises a gate having an arched lower edge defining first and second planar columns, said gate cooperating with said stand to secure the dowel therebetween, said first and second planar columns adapted to be interposed vertically into said channel between said first and second spaced apart sheets until said arched lower edge bears against said dowel.

4. The mounting apparatus as recited in claim 3 further including means for securing said planar columns in said channel.

5. The mounting apparatus as recited in claim 4 wherein said channel further comprises a plurality of notches spaced vertically, and said means for securing said planar columns comprises wedge means along said first and second planar columns for engaging said notches to secure said gate in said channel.

6. The mounting apparatus as recited in claim 5 wherein said stand further comprises means for separating a predetermined upper portion of said vertical extensions whereby a height of said stand can be reduced.

7. The mounting apparatus as recited in claim 4 further comprising a plurality of leg means for stabilizing said mounting apparatus and for balancing said mounting apparatus on a generally level surface.

8. The mounting apparatus as recited in claim 7 wherein each leg means further comprise a tab means protruding from a lower end of a first edge, said tab means adapted to cooperate with an edge of a retaining plate for securing said mounting apparatus onto said retaining plate.

9. The mounting apparatus as recited in claim 4 wherein said vertical mouth further includes a recess along an edge defining a contour thereof.

10. The mounting apparatus as recited in claim 2 wherein each said vertical extension comprise first and second spaced apart sheets defining a channel therebetween, and where in said means for securing said dowel comprises a flexible strap which is mountable at a first side of said stand, and which passes between said sheets over said dowel to be fixed on a second side of said stand to secure said dowel in said vertical mouth.

11. The mounting apparatus as recited in claim 10 wherein said stand further comprises means for separating a predeterinined upper portion of said vertical extensions whereby a height of said stand can be reduced.

12. The mounting apparatus as recited in claim 11 further comprising a plurality of leg means for stabilizing said mounting apparatus and for balancing said mounting apparatus on a generally level surface.

13. The mounting apparatus as recited in claim 12 wherein each leg means further comprise a tab means protruding from a lower end of a first edge, said tab means adapted to cooperate with an edge of a retaining plate for securing said mounting apparatus onto said retaining plate.

14. The mounting apparatus as recited in claim 13 wherein said vertical mouth further include s a recess along an edge defining a contour thereof.

15. A concrete joint restraint system for supporting at least two cylindrical dowels aligned in a horizontally spaced apart relationship comprising:

a dowel mounting apparatus for each of said cylindrical dowels comprising a pair of stands each with a vertical mouth opening at a top edge, said vertical mouth reducing in width from a maximum width at a top of said vertical mouth to a minimum width at a bottom of said vertical mouth such that a cylindrical dowel with a diameter smaller than said maximum width will rest on said pair of stands within said vertical mouths generally at the width of said vertical mouths equal to the diameter of said dowel whereby different-sized diameter dowels can be supported therein;

dowel securing means for radially securing said dowel in said vertical mouth while permitting said dowel to move in a longitudinal direction within said mouth; and dowel support alignment means for aligning an adjacent pair of stands in a predetermined spaced apart relationship.

16. The concrete joint restraint system as recited in claim 15 wherein said dowel support alignment means comprises first and second retaining plates each having a recessed area sized to receive one of said stands, and an elongated beam member connected to said first and second retaining plates to align said adjacent stands in said predetermined spaced apart relationship.

17. The concrete joint restraint system as recited in claim 16 wherein said dowel mounting device and said dowel securing means are comprised of corrosion resistant fiberglass material.

18. The concrete joint restraint system as recited in claim 17 further comprising end caps mounted to at least one end of one pair of said stands and enclosing one end of the dowel mounted therein, said end cap comprising a hollow cylinder having an open first end and a closed second end, said open end receiving said end of said dowel.

19. The concrete joint restraint system as recited in claim 18 wherein each said stand includes first and second spaced apart sheets defining a channel therebetween, and wherein said dowel securing means comprises a gate having an arched lower edge defining first and second planar columns, said gate cooperating with said stand to secure the dowel therebetween, said first and second planar columns adapted to be interposed vertically into said channel between said first and second spaced apart sheets until said arched lower edge bears against said dowel.

20. The concrete joint restraint system as recited in claim 19 wherein said mounting apparatus includes means for securing said planar columns in said channel.

21. The concrete joint restraint system as recited in claim 20 wherein said channel further comprises a plurality of notches spaced vertically, and said means for securing said planar columns comprises wedge means along said first and second planar columns for engaging said notches to secure said gate in said channel.

22. The concrete joint restraint system as recited in claim 21 wherein said stand further comprises means for removing a predetermined upper portion of said vertical extensions whereby a height of said stand can be reduced.

23. The concrete joint restraint system as recited in claim 21 further comprising a plurality of leg means for stabilizing said mounting apparatus and for balancing said mounting apparatus on a generally level surface.

24. The concrete joint restraint system as recited in claim 23 wherein each leg means further comprise a tab means protruding from a lower end of a first edge, said tab means adapted to cooperate with an edge of said retaining plate for securing said mounting apparatus onto said retaining plate.

25. The concrete joint restraint system as recited in claim 21 wherein said vertical mouth further includes a recess a long an edge defining a contour thereof, said contour adapted to receive said end cap therein.

26. The concrete joint restraint system as recited in claim 25 further comprising an expansion joint perpendicular to an axis of said dowels, said expansion joint comprising a pane of compressible material positioned generally midway between said first and second stands.

27. The concrete joint restraint system as recited in claim 26 further comprising spacing means connected to said first and second stands of said mounting apparatus for positioning said stands at a predetermined distance from each other.

* * * * *